US008881315B2

(12) United States Patent
Desjardins et al.

(10) Patent No.: US 8,881,315 B2
(45) Date of Patent: Nov. 11, 2014

(54) PROTECTIVE HELMET

(71) Applicant: Sport Maska Inc., Montreal (CA)

(72) Inventors: André Desjardins, Montreal (CA); Philippe Martin, Montreal (CA); Ryan Crelinsten, Montreal (CA)

(73) Assignee: Sport Maska Inc., Montreal (CA)

( * ) Notice: Subject to any disclaimer, the term of this patent is extended or adjusted under 35 U.S.C. 154(b) by 0 days.

(21) Appl. No.: 13/793,798

(22) Filed: Mar. 11, 2013

(65) Prior Publication Data

US 2013/0185848 A1 Jul. 25, 2013

Related U.S. Application Data

(63) Continuation of application No. 11/954,969, filed on Dec. 12, 2007, now Pat. No. 8,418,270.

(51) Int. Cl.
*A42B 3/04* (2006.01)

(52) U.S. Cl.
USPC ..... 2/420; 2/410; 2/412; 2/425

(58) Field of Classification Search
USPC ..... 2/410–414, 425, 455, 420
See application file for complete search history.

(56) References Cited

U.S. PATENT DOCUMENTS

| | | | | |
|---|---|---|---|---|
| 3,950,483 | A | 4/1976 | Spier | |
| 4,404,690 | A * | 9/1983 | Farquharson | 2/420 |
| 5,012,533 | A * | 5/1991 | Raffler | 2/420 |
| 5,074,765 | A | 12/1991 | Pekar | |
| 5,083,320 | A | 1/1992 | Halstead | |
| 5,113,599 | A | 5/1992 | Cohen et al. | |
| 5,129,107 | A | 7/1992 | Lorenzo | |
| 5,144,708 | A | 9/1992 | Pekar | |
| 5,263,203 | A | 11/1993 | Kraemer et al. | |
| 5,667,737 | A | 9/1997 | Wittmann | |
| 5,913,412 | A | 6/1999 | Huber et al. | |
| 5,956,777 | A | 9/1999 | Popovich | |
| 6,105,176 | A * | 8/2000 | Egger | 2/425 |
| 6,292,952 | B1 | 9/2001 | Watters et al. | |
| 6,298,497 | B1 * | 10/2001 | Chartrand | 2/414 |
| 6,324,700 | B1 * | 12/2001 | McDougall | 2/417 |
| 6,339,849 | B1 * | 1/2002 | Nelson et al. | 2/425 |
| 6,385,780 | B1 * | 5/2002 | Racine | 2/414 |
| 6,442,765 | B1 * | 9/2002 | Fallon et al. | 2/410 |
| 6,964,116 | B2 * | 11/2005 | Kroll et al. | 34/96 |
| 6,966,075 | B2 * | 11/2005 | Racine | 2/425 |
| 6,996,856 | B2 * | 2/2006 | Puchalski | 2/411 |
| 7,076,811 | B2 * | 7/2006 | Puchalski | 2/411 |
| 7,721,348 | B2 | 5/2010 | Nurnberg | |
| 7,870,618 | B2 * | 1/2011 | Pilon et al. | 2/417 |
| 2003/0135914 | A1 * | 7/2003 | Racine et al. | 2/413 |
| 2005/0028404 | A1 | 2/2005 | Marvin et al. | |
| 2005/0268383 | A1 | 12/2005 | Harris | |
| 2008/0254281 | A1 * | 10/2008 | Chen et al. | 428/335 |
| 2009/0188022 | A1 | 7/2009 | Durocher et al. | |

* cited by examiner

*Primary Examiner* — Christopher Harmon
(74) *Attorney, Agent, or Firm* — Sterne, Kessler, Goldstein & Fox P.L.L.C.

(57) ABSTRACT

A helmet, which includes an injection molded shell having an inner surface and an outer surface, the injection molded shell including a first main body portion and a second main body portion, wherein the first and second main body portions are formed of a first material; and a first molded hinge portion formed intermediate the first and second main body portions, the molded hinge portion adapted to allow the first main body portion and the second main body portion to move relative to each other.

19 Claims, 10 Drawing Sheets

PROTECTIVE HELMET

CROSS-REFERENCE TO RELATED APPLICATIONS

This application is a continuation of U.S. patent application Ser. No. 11/954,969, titled "Protective Helmet," filed Dec. 12, 2007, which is incorporated herein by reference in its entirety.

BACKGROUND OF THE INVENTION

1. Field of the Invention

Embodiments of the present invention generally relate to a protective helmet.

2. Background Art

Participants in sports involving contact with other players or objects are particularly susceptible to head and brain injuries. It is well known to use various types of protective headgear during participation in these sporting activities to prevent or limit injuries. The amount of protection afforded by headgear is determined by many factors, including the fit of the headgear on the user's head and the type, location, and amount of padding used in the headgear.

Furthermore, players of different sports require various degrees of protection from headgear depending on the amount of head impact commonly encountered in the sport. In sports such as American football, where violent head to head or head to ground contact is commonplace, the ideal headgear has a substantial amount of padding and is formed of a substantially rigid shell so as to provide maximum protection to the athlete. In sports involving somewhat lower impact forces to the head, such as hockey, the ideal headgear is more closely tailored to the shape of the user's head while still providing sufficient protection.

To achieve a tailored fit, it is well known to construct hockey helmets with separate front and back pieces. This construction allows for a degree of custom fitting, but results in a helmet that is adjustable only along one axis. Other helmet constructions utilize adjustable liner systems. While these systems improve the fit of the helmet, the size of the helmet shell itself is not adjustable. This results in a helmet with a shell that is unnecessarily bulky. Thus, there is a need for a helmet that allows for an improved fit to the head of an athlete.

There is also a need for a helmet with a shell that allows for an improved fit while at the same time offering an adjustable amount of padding. Inflatable articles of manufacture or bladders for use in inflatable articles of manufacture have been known for decades. Such articles of manufacture include inflatable air mattresses and pillows, inflatable life preservers and rafts, and athletic equipment. In the field of athletic equipment, inflatable bladders have been incorporated in the interior of balls (e.g., basketballs, footballs, soccer balls, etc.), as well as in articles of protective apparel, gloves, chest protectors and footwear.

U.S. application Ser. No. 10/887,927 filed on Jul. 12, 2004 (and published as U.S. Published Patent Application No. 20050028404-A1 on Feb. 10, 2005), the disclosure of which is incorporated herein by reference in its entirety, discloses a shoe having an inflatable bladder. Other pumps and valves, suitable for use, among other things, with inflatable bladders for helmets, are disclosed in U.S. Pat. Nos. 5,113,599, 5,074,765 and 5,144,708, the disclosures of which are incorporated herein by reference in their entirety.

Inflatable bladders have also been incorporated into protective helmets. However, these helmets are bulky and not well adapted to sports where a helmet with a more tailored fit is required. Accordingly, there is a need in the art to have a lightweight protective helmet that is able to provide a custom fit to an individual user while at the same time providing an adequate amount of cushioning.

BRIEF SUMMARY OF THE INVENTION

Applicant has developed an innovative protective helmet, comprising: an injection molded shell having an inner surface and an outer surface, the injection molded shell comprising: a first main body portion and a second main body portion, wherein the first and second main body portions are formed of a first material; and a first molded hinge portion formed intermediate the first and second main body portions, the molded hinge portion adapted to allow the first main body portion and the second main body portion to move relative to each other.

Applicant has further developed an innovative helmet, comprising: an injection molded shell having an inner surface and an outer surface, the injection molded shell comprising: a left portion; a right portion; and a center portion disposed intermediate the left portion and the right portion; a first molded hinge portion integrally formed intermediate the left portion and the center portion, wherein the first molded hinge portion is adapted to allow the left portion and the center portion to move relative to each other; and a second molded hinge portion integrally formed intermediate the right portion and the center portion, wherein the second molded hinge portion is adapted to allow the right portion and the center portion to move relative to each other.

Applicant has developed an innovative helmet comprising: a dual-injected shell having a plurality of sections, wherein each section has an exterior surface and an interior surface, the dual-injected shell comprising: a molded hinge formed in the shell, the molded hinge allowing at least two of the sections to move relative to each other; an inflatable bladder affixed to a portion of the interior surface, and an inflation mechanism fluidly connected to the inflatable bladder.

Applicant has developed a helmet comprising: a dual-injected shell having a plurality of sections, the dual-injected shell comprising: an over-molded bumper, and a molded hinge, wherein the molded hinge allows two or more of the sections to move relative to each other; wherein at least two of the molded hinge, the over-molded bumper, and the sections are formed of differently colored materials.

BRIEF DESCRIPTION OF THE DRAWINGS/FIGURES

The accompanying drawings, which are incorporated heroin and form a part of the specification, illustrate the present invention and, together with the description, further serve to explain the principles of the invention and to enable a person skilled in the pertinent art to make and use the invention.

DETAILED DESCRIPTION OF THE INVENTION

The present invention will now be described in detail with reference to embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order not to unnecessarily obscure the present invention.

Figure 1:
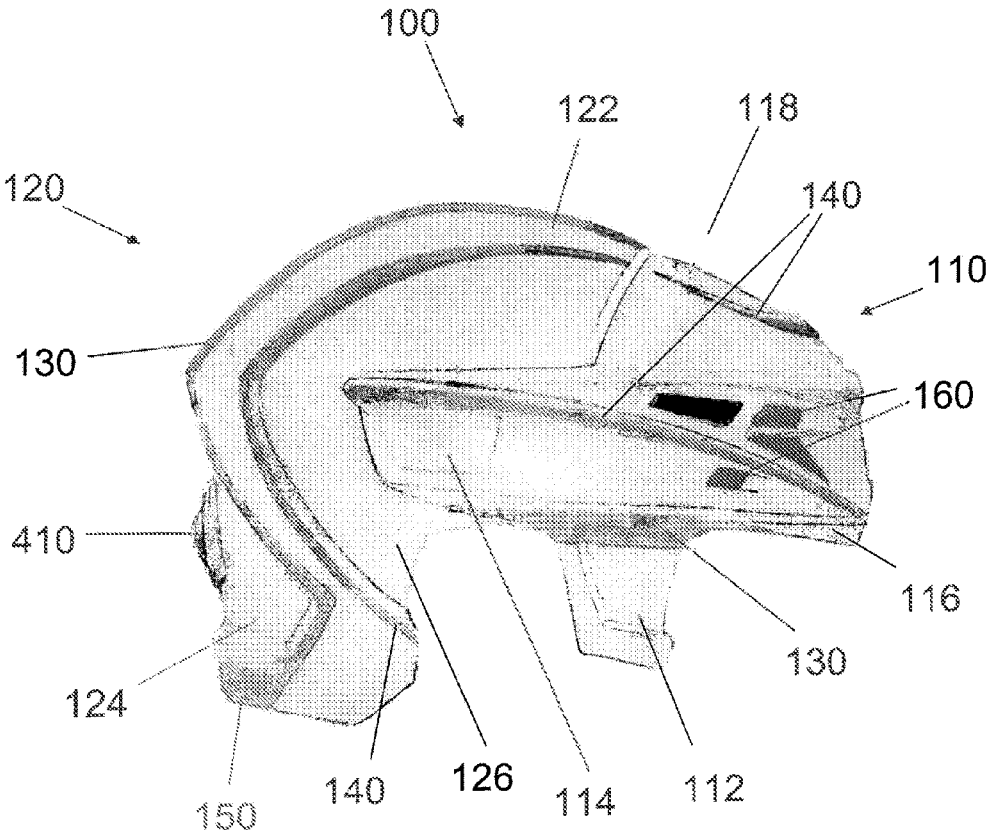
FIG. 1 is a right side plan view of a dual-injected helmet with molded hinges, over-molded bumpers, and an on-board pump for use in inflating a bladder serving as a helmet liner according to an embodiment of the present invention.

The present invention is directed to a protective helmet, particularly a helmet designed for use in sports where a streamlined helmet is desirable, such as ice hockey or the like. FIG. 1 is a right side plan view of a dual-injection molded helmet shell 100. The left and right sides of helmet shell 100 are generally symmetrical. Thus, it is understood that the left side (not shown) of helmet shell 100 is generally a mirror image of FIG. 1.

Helmet shell 100 includes a front section 110 and a rear section 120 joined together. In one embodiment, front section 110 and rear section 120 are joined by a screw and post combination. As would be apparent to one of skill in the art, front section 110 and rear section 120 could also be joined by other methods such as riveting. In a preferred embodiment, helmet shell 100 is formed of HDPE (high density polyethylene). However, helmet shell 100 could also be formed of a variety of high impact resins suitable for use in protective headgear. The left and right sides of helmet shell 100 are generally symmetrical. Alternatively, helmet 100 could be formed of more than two sections or could be formed as a single unit. Helmet shell 100 comprises a plurality of molded hinges 130 formed by a process of dual-injection molding or co-molding. Molded hinges 130 can be located in a variety of areas on a helmet shell to improve the fit of the shell on the head of a user. For example, in the embodiment shown in FIG. 1, front section 110 comprises a molded hinge 130 located intermediate the main portion of front section 110 and a temple flange 112. Molded hinge 130 allows temple flange 112 to pivot relative to the main portion of front section 110 to improve the fit of the helmet to a user's head.

Figure 7:
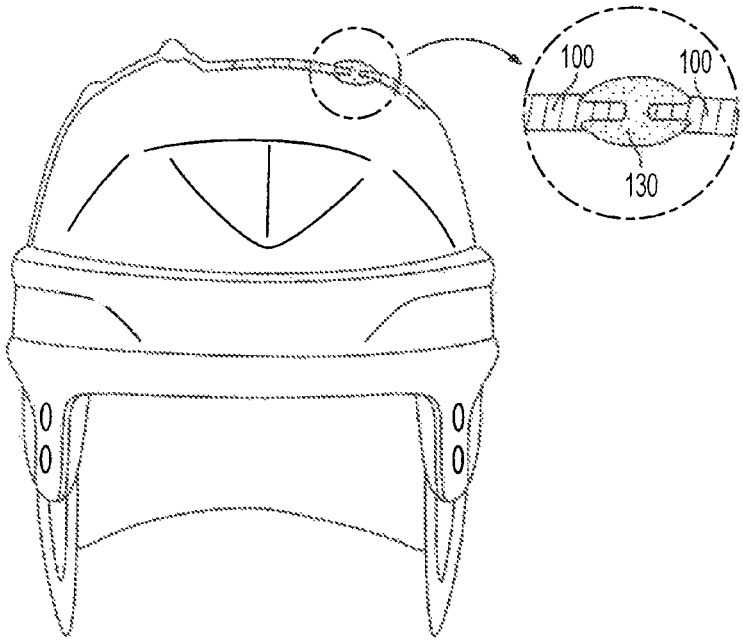
FIG. 7 is a cross section of a molded hinge according to one embodiment of the present invention.

As shown in FIG. 1, helmet shell 100 may also comprise molded hinges 130 located on rear section 120 of helmet shell 100. In the embodiment shown in FIG. 1, rear section 120 is provided with a molded hinge 130 that begins on a forward upper portion 122 of rear section 120 at a location proximal to front section 110 and extends generally to a lower rear portion 124 of rear section 120. An identical molded hinge 130 extends down the left side (not shown) of rear section 120 of helmet shell 100. FIG. 7 shows a cross section of one embodiment of a molded hinge according to an embodiment of the present invention. In embodiments of the present invention, molded hinges 130 are formed by a process of dual-injection or co-molding.

Helmet shell 100 may also comprise a flex zone 150 located on the lower-most perimeter of lower rear portion 124 of rear section 120. Flex zone 150 is designed to contact the user's neck when the helmet is worn, thereby providing an improved fit and increased comfort.

Figure 8:
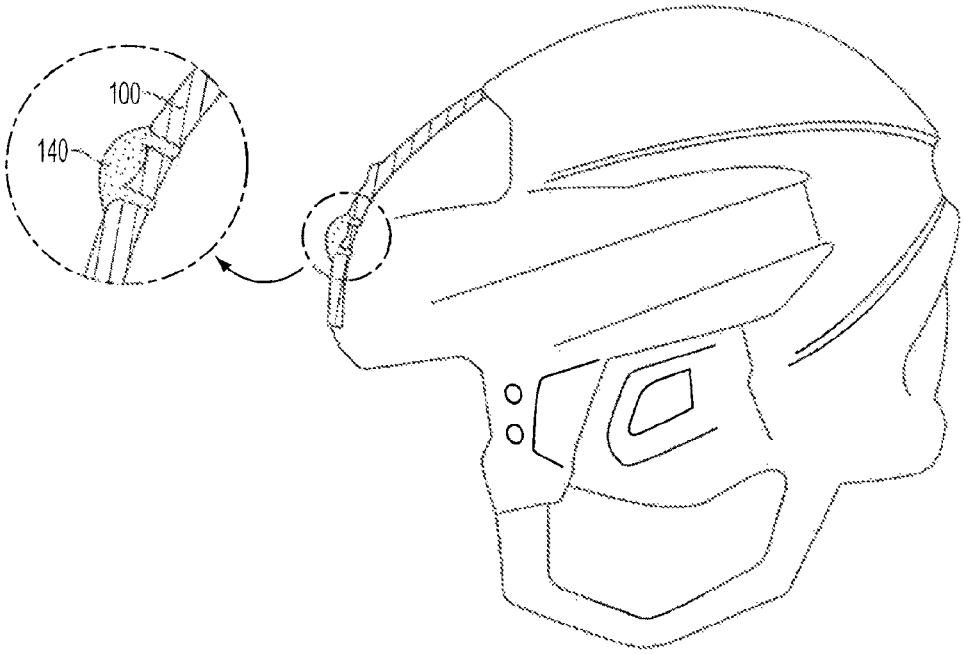
FIG. 8 is a cross section of an over-molded bumper according to one embodiment of the present invention.

Helmet shell 100 may also comprise one or more bumpers 140. Over-molded bumpers 140 provide impact attenuation or vibration control when the helmet collides with an object. Over-molded bumpers 140 can be formed in a variety of locations on helmet shell 100, but are preferably placed in locations where collisions are most common or where substantial vibration is experienced following a collision. FIGS. 1-6 illustrate several embodiments that demonstrate locations for molded hinges and over molded bumpers. For example, as shown in FIG. 1, helmet shell 100 may comprise an over-molded bumper extending from a right rear portion 114 of front section 110 to a right front portion 116 of front section 110. An additional over-molded bumper 140 may be located on an upper front portion 118 of front section 110. FIG. 8 shows a cross section of an over-molded bumper according to an embodiment of the present invention. In a preferred embodiment, bumpers 140 are over-molded onto a separately molded helmet shell. Alternatively, bumpers 140 could be formed on helmet shell 100 by dual-injection or co-molding, or could be applied to helmet shell 100 after molding is completed.

Helmet shell 100 may also comprise one or more over-molded bumpers 140 on rear section 120. For example, as shown in FIG. 1, an over-molded bumper may be provided on rear section 120 extending generally from a upper front portion 122 to a lower right portion 126.

Molded hinges 130, over-molded bumpers 140, and flex zone 150 may each be formed from a different material, or may each be formed of the same material, but with differing hardness or stiffness. Similarly, front section 110 and rear section 120 may each be formed of different materials, and may be formed of different materials than one or more of molded hinges 130, over-molded bumpers 140, and flex zone 150. In addition, each component of helmet shell 100 could be formed of materials having different colors, or of the same material with different colors, to achieve a desired aesthetic effect.

Helmet shell 100 may also be provided with one or more ventilation apertures 160 which allow air to pass through the shell. FIG. 1 shows a plurality of ventilation apertures 160 located generally at a right front portion 116 of front section 110. In addition, as shown in FIG. 2, helmet shell 100 may have a plurality of ventilation apertures 160 on a center portion of rear section 120.

Helmet shell 100 may also have an inflatable bladder provided on the interior of front section 110 and rear section 120. As shown in FIGS. 1 and 2, an on-board manually operated inflation mechanism 410 may be included as means for inflating the bladder. As further shown in FIGS. 1 and 2, inflation mechanism 410 may be provided on the lower rear portion 124 of rear section 120. It is understood that inflation mechanism 410 could also be located at other positions on helmet shell 100.

Figure 2:
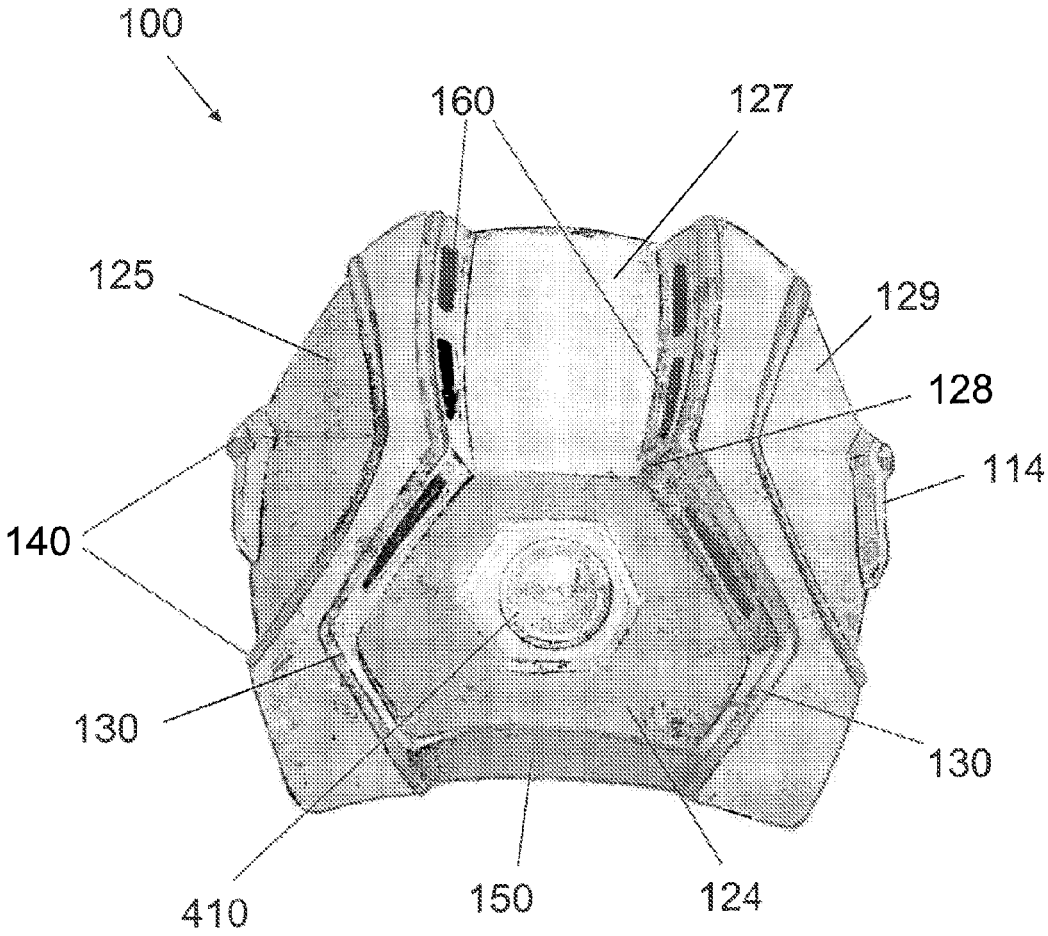
FIG. 2 is a rear plan view of the helmet of FIG. 1.

FIG. 2 is a rear plan view of helmet shell 100 according to an embodiment of the present invention. As apparent from FIG. 2, rear section 120 of helmet shell 100 comprises a left side 125, a center channel 127, and a right side 129. Center channel 127 begins at the top of rear section 120 at a location proximal to the intersection of rear section 120 and front section 110 and extends to flex zone 150 following the contour of a user's head. Center channel 127 includes sidewalls 128 that extend generally in a perpendicular direction from the base of center channel 127 to molded hinges 130. Molded hinges 130 define the boundaries between center channel 127 and left and right sides 125 and 129. Ventilation apertures 160 may be provided on sidewalls 128, as shown in FIG. 2. Ventilation apertures could also be placed at other locations on helmet shell 100 to aid in cooling the head of a user and decreasing the weight of the helmet. In an alternative embodiment, helmet shell 100 could also be formed with no center.

Figure 3:
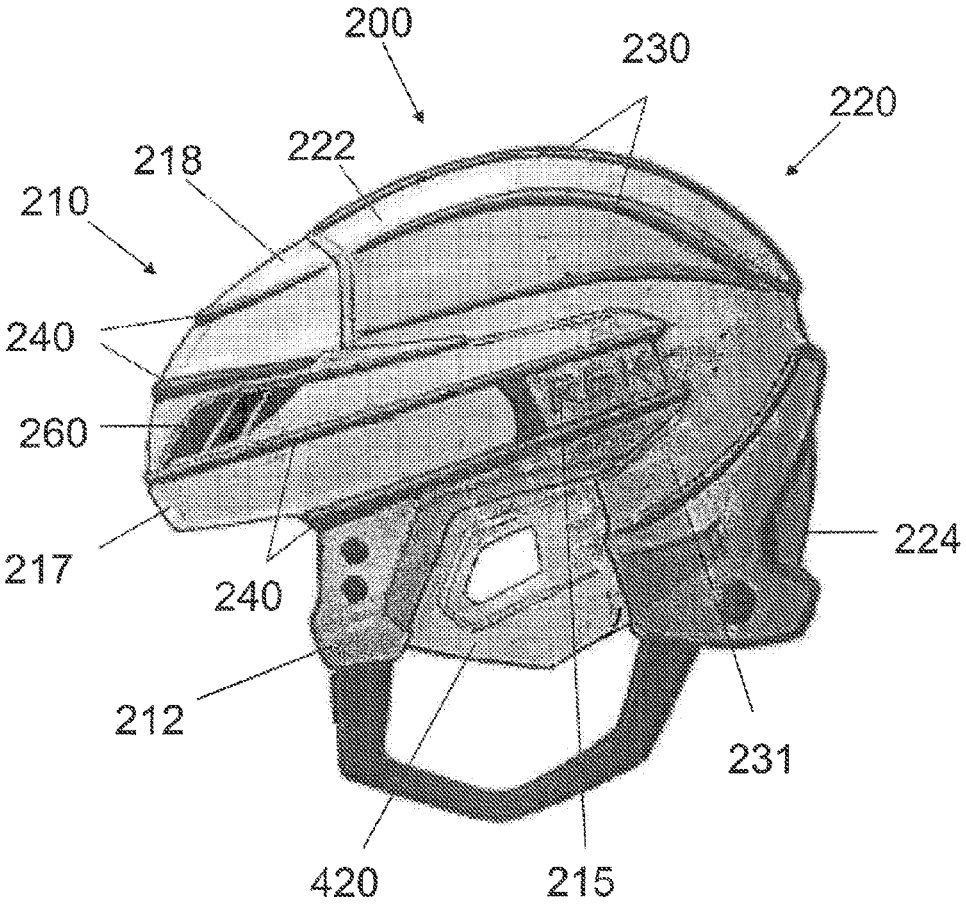
FIG. 3 is a left side plan view of a helmet according to a second embodiment of the present invention.

Molded hinges and over-molded bumpers can be located at various positions on a helmet in order to achieve the desired fit to a wearer's head and collision protection. FIG. 3 demonstrates one of the many possible configurations of over-molded bumpers and molded hinges on a helmet. Helmet 200 has a molded hinge extending from the left side of upper front portion 222 of rear section 220 to the crown region of rear section 220, and then wrapping back to the right side of upper front portion 222. Over-molded bumpers are provided in several locations on front section 210 in order to absorb impact during collisions.

Figure 4:
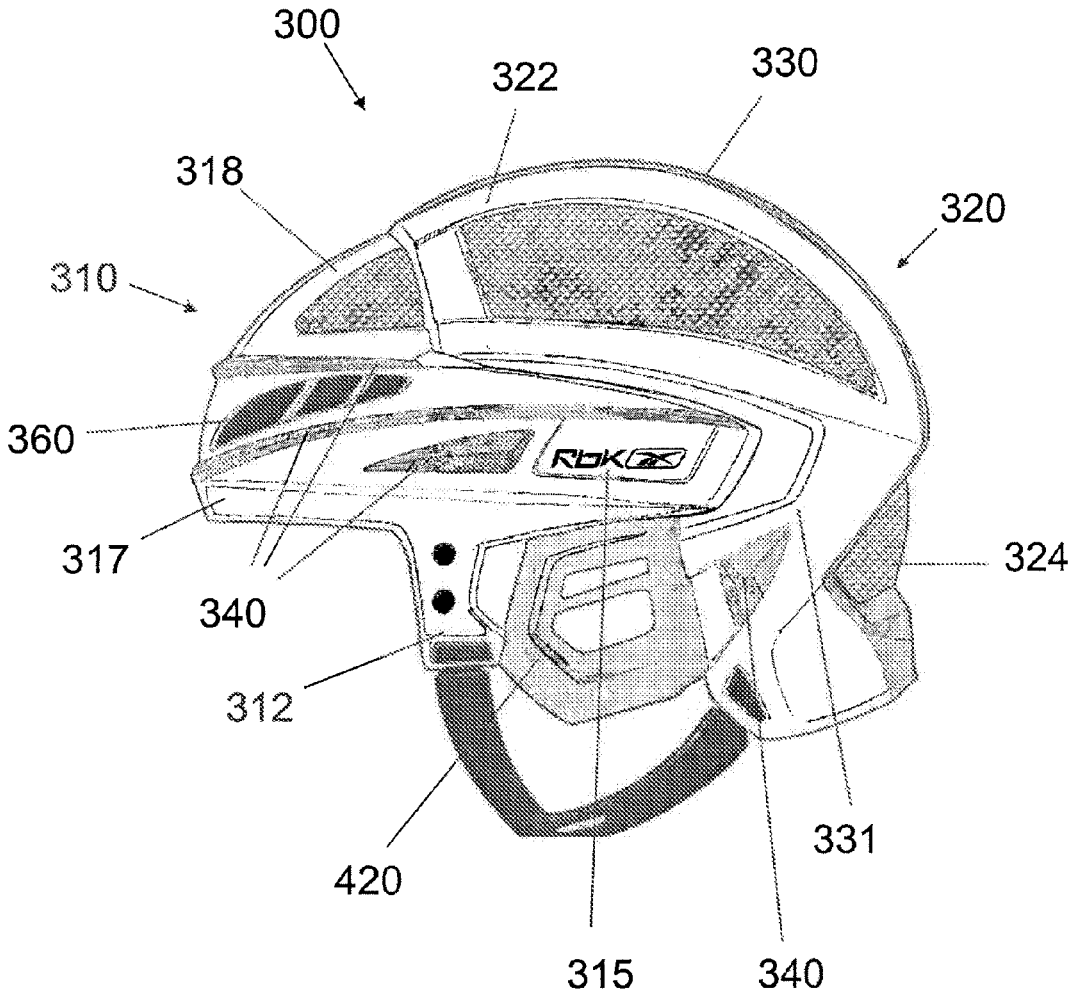
FIG. 4 is a left side plan view of a helmet according to a third embodiment of the present invention.
Figure 5:
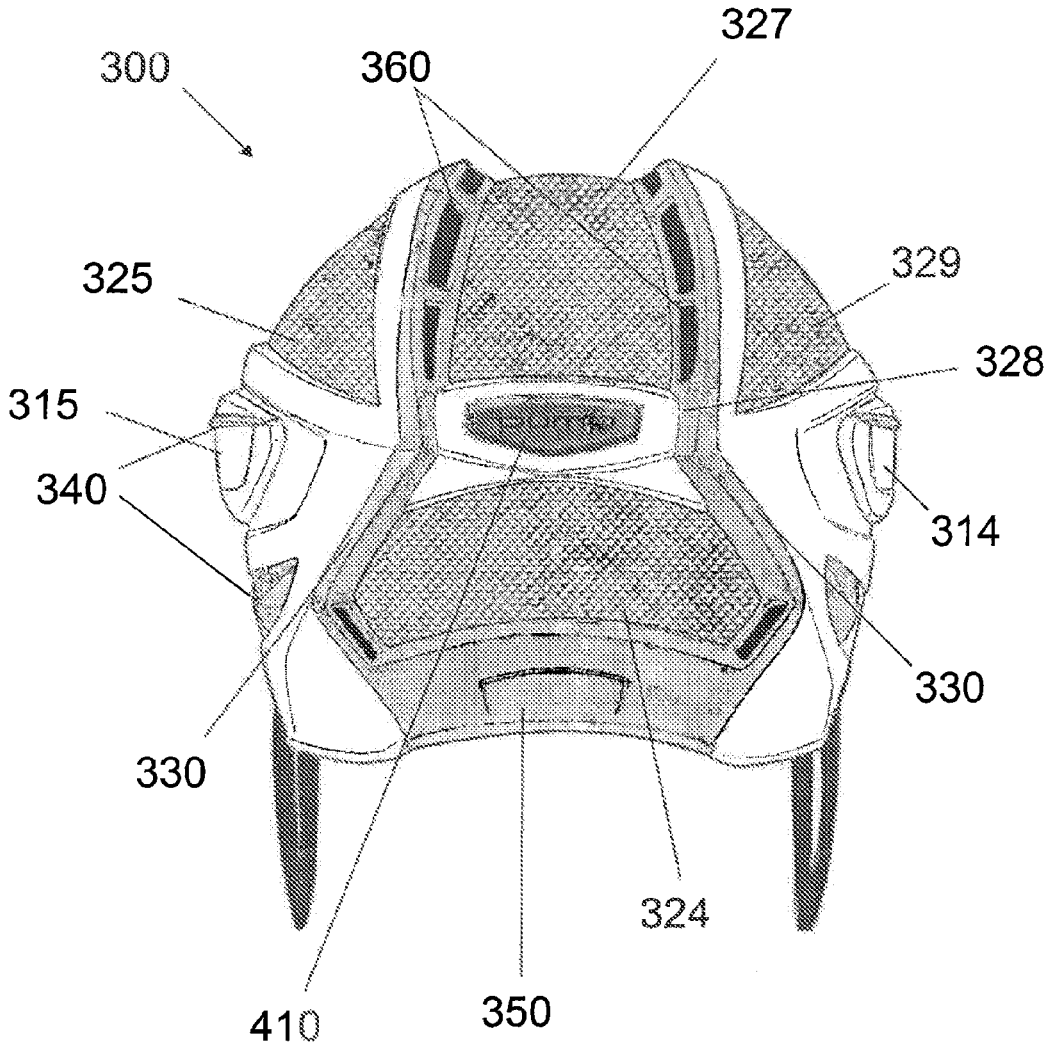
FIG. 5 is a rear plan view of the helmet of FIG. 4.
Figure 6:
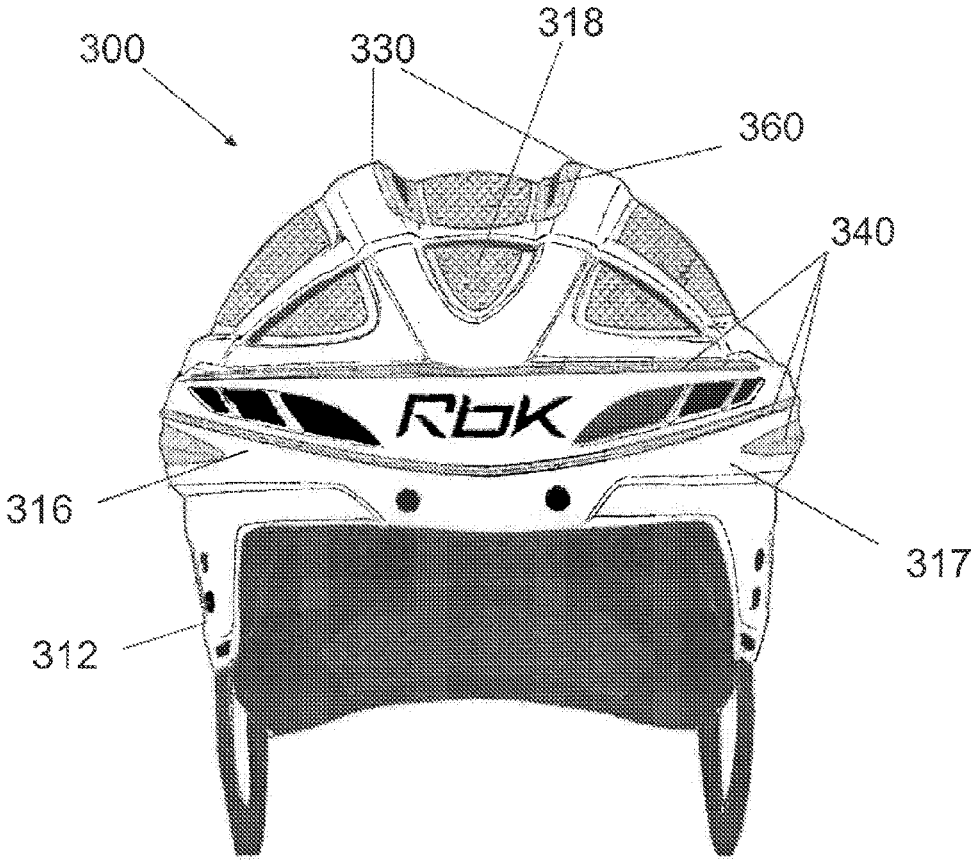
FIG. 6 is a front plan view of the helmet of FIG. 4.

FIGS. 3-6 depict another embodiment of a helmet of the present invention. As shown in FIGS. 4 and 6, two over-molded bumpers 340 extend from the left front portion 317 to the right front portion 316 of front section 310. Over-molded bumpers 340 are also provided directly above temple flanges 312 on each side of helmet 300. Molded hinges 330 are located on rear section 320 of helmet shell 300. As shown in FIG. 5, rear section 320 is provided with a molded hinge 330 that begins on a forward upper portion 322 of rear section 320 at a location proximal to front section 310 and extends to a lower rear portion 324 of rear section 320. An identical molded hinge 330 extends down the left side of rear section 320 of helmet shell 100. Flex zone 350 is located on the lower-most perimeter of lower rear portion 324 of rear section 320. Flex zone 350 is designed to contact the user's neck when the helmet is worn, thereby providing improved fit and increased comfort.

FIG. 5 also shows an alternate location for inflation mechanism 410. As would be apparent to one of skill in the art, inflation mechanism 410 can be located in a variety of positions on a helmet shell of the present invention.

Figure 9:
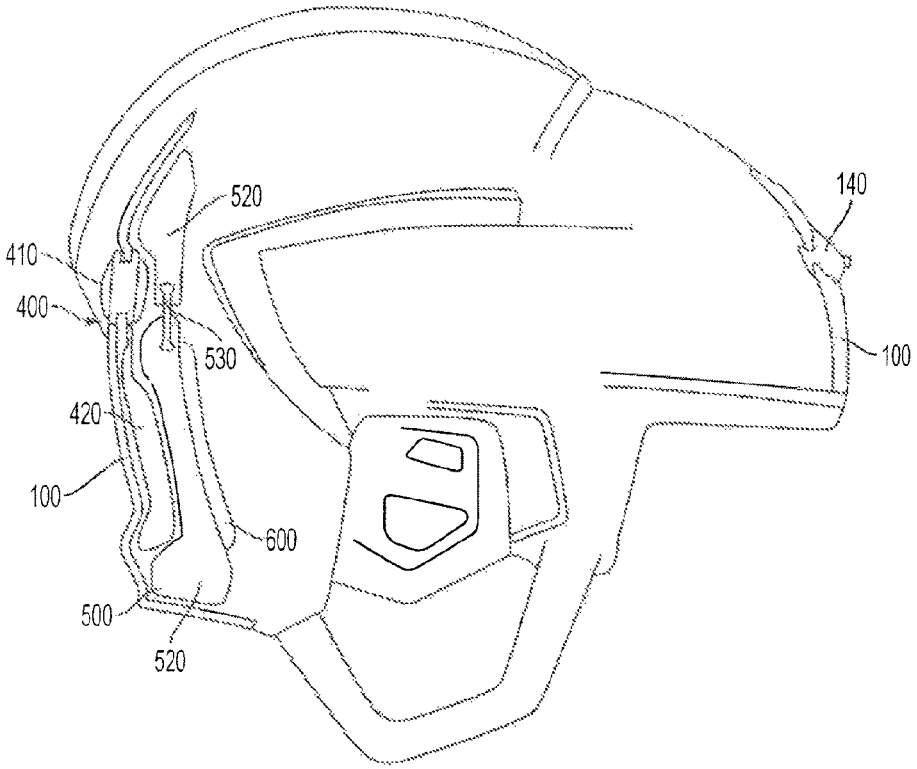
FIG. 9 is a cross section of a helmet and bladder system according to one embodiment of the present invention.
Figure 10:
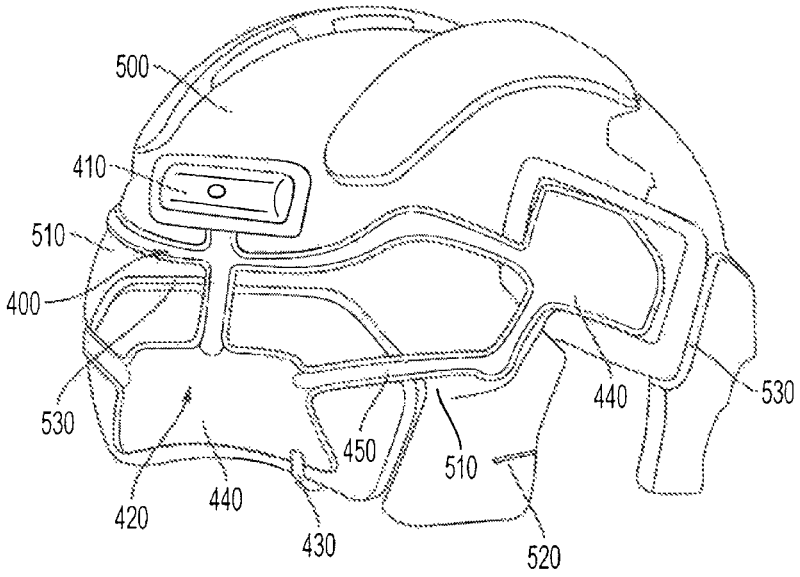
FIG. 10 is a perspective view of an impact liner and associated bladder system according to an embodiment of the present invention.

FIG. 9 shows a cross section of a helmet according to an embodiment of the present invention. The helmet comprises a helmet shell 100 with an inflatable device 400 coupled thereto. As shown in FIGS. 9 and 10, inflatable device 400 includes an inflation mechanism 410, one or more inflatable bladders 420, and fluid release mechanism 430. In one embodiment, the inflation mechanism 410 and the fluid release mechanism 430 may be combined. Bladder 420 is disposed on the interior of helmet shell 100 and is in fluid communication with inflation/release mechanism 410. As shown in FIG. 9, additional layers, such as impact liner 500 and comfort liner 600, may be provided on the interior of helmet shell 100 to provide additional cushioning. In the embodiments shown in FIGS. 9 and 10, impact liner 500 is formed with one or more hinges 530 which allow certain areas of the impact liner to move relative to the impact liner as a whole. Hinges 530 may be formed from traditional hinging methods or molded hinges.

Inflatable device 400 is shown in farther detail in FIG. 10. In order for a user to customize the amount of air in the bladder, bladder 420 is in communication with an inflation mechanism 410. In the embodiments shown in FIGS. 1, 5, 9 and 10, inflation mechanism 410 is located in the rear section of helmet a helmet shell. However, in alternate embodiments, inflation mechanism 410 may be located on a side of helmet shell 100 or any other area of the helmet, as would be apparent to one skilled in the relevant art. Bladder 420 comprises one or more air pockets 440 connected by one or more air channels 450. In a preferred embodiment, air channels 450 are located in one or more depressions 510 in impact liner 500 to allow a secure fit in helmet shell 100. Air pockets 440 are preferably located on movable portions 520 of impact liner 500. Increasing pressure is applied to movable portions 520 as air pockets 440 are inflated and thereby push against the interior of helmet shell 100. This pressure forces movable portions 520 closer to a user's head in key areas to provide a customized fit. In the embodiment shown in FIG. 10, movable portions 520 and air pockets 440 are positioned beneath helmet shell 100 at locations corresponding to lower rear portion 124 and right rear portion 114, with reference to the embodiment shown in FIG. 1. As would be apparent, movable portions 520 and air pockets 440 could be located in alternate areas under helmet shell 100 to achieve the desired fit. In addition, inflatable device 400 could be used with a traditional impact liner without movable portions.

A variety of different inflation mechanisms can be utilized in embodiments of the present invention. The inflation mechanism may be a simple latex bulb which is physically attached to the helmet. Alternatively, the inflation mechanism may be a molded plastic chamber, or may be a hand held pump such as one which utilizes $CO_2$ gas to inflate a bladder.

Preferably, the inflation mechanism is small, lightweight, and provides a sufficient volume of air such that little effort is needed for adequate inflation. For example, U.S. Pat. No. 5,987,779, which is incorporated by reference, describes an inflation mechanism comprising a bulb (of various shapes) with a one-way check valve. When the bulb is compressed air within the bulb is forced into the desired region. As the bulb is released, the check valve opens because of the pressure void in the bulb, allowing ambient air to enter the bulb.

Another inflation mechanism, also described in U.S. Pat. No. 5,987,779, incorporated herein by reference, is a bulb having a hole which acts as a one-way valve. A finger can be placed over the hole in the bulb upon compression. Therefore, the air is not permitted to escape through the hole and is forced into the desired location. When the finger is removed, ambient air is allowed to enter through the hole. An inflation mechanism having collapsible walls in order to displace a greater volume of air may be preferred. A similar inflation mechanism may include a temporarily collapsible foam insert. This foam insert ensures that when the bulb is released, the bulb expands to the natural volume of the foam insert drawing in air to fill that volume. A preferred foam is a polyurethane, such as the 4.25 4.79 pound per cubic foot polyether polyurethane foam, part number FS-170-450TN, available from Woodbridge Foam Fabricating, 1120-T Judd Rd. Chattanooga, Tenn., 37406.

U.S. Pat. No. 6,287,225, incorporated herein by reference, describes another type of on-board inflation mechanism suitable for the present invention. Yet another type of on-board inflation mechanism, wherein the inflation mechanism is formed from an isolated portion of the bladder, is disclosed in U.S. Pat. No. 7,047,670, incorporated herein by reference. One skilled in the art can appreciate that a variety of inflation mechanisms are suitable for the present invention. In addition, any inflation mechanism is appropriate for use with any embodiments of the present invention.

These inflation mechanisms all require a one-way valve be placed between the inflation mechanism and the bladder, so that once air enters the system it may not travel backwards into the inflation mechanism. Various types of one-way valves are suitable for use in conjunction with the various inflation mechanisms of the present invention. Preferably, the valve will be relatively small and flat for less bulkiness. U.S. Pat. No. 5,144,708 to Pekar, incorporated herein by reference, describes a valve suitable for the present invention. The patent describes a valve formed between thermoplastic sheets. The valve described in the Pekar patent allows for simple construction techniques to be used whereby the valve can be built into the system at the same time the bladder is being welded. One skilled in the art would understand that a variety of suitable valves are contemplated in the present invention.

The one-way valve provides a method to avoid over inflation of the system. In particular, if the pressure in the bladder is equal to the pressure exerted by the inflation mechanism, no additional air will be allowed to enter the system. In fact, when an equilibrium is reached between the pressure in the bladder and the pressure of the compressed inflation mechanism, the one-way valve which opens to allow air movement from the inflation mechanism to the bladder 420 may remain closed. Even if this valve does open, no more air will enter the system. Further, one skilled in the art can design an inflation mechanism to have a certain pressure output to limit the amount of air that can be pumped into bladder 420. Any one-way valve will provide a similar effect, as would be known to one skilled in the art. In addition, any one-way valve would be appropriate for use in any embodiments of the present invention.

In one embodiment of the present invention, as shown in FIG. 10, fluid release mechanism 430 is a deflation valve. The particular deflation valve in FIG. 10 is a release valve. Fluid release mechanism 430 is fluidly connected to bladder 420 and allows the user to personally adjust the amount of air inserted into bladder 420, particularly if the preferred comfort level is less than the pressure limits otherwise provided by the bladder. The release valve can comprise any type of release valve. One type of release valve is the plunger-type described in U.S. Pat. No. 5,987,779, incorporated herein by reference, wherein the air is released upon depression of a plunger which pushes a seal away from the wall of the bladder allowing air to escape. In particular, a release valve may have a spring which biases a plunger in a closed position. A flange around the periphery of the plunger can keep air from escaping between the plunger and a release fitting because the flange is biased in the closed position and in contact with the release fitting. To release air from bladder 420, the plunger is depressed by the user. Air then escapes around the stem of the plunger. This type of release valve is mechanically simple and light weight. The components of a release valve may be made out of a number of different materials including plastic or metal. Any release valve is appropriate for use in any embodiment of the present invention.

FIG. 10 shows one possible location of fluid release mechanism 430 on helmet shell 100. However fluid release mechanism 430 may be positioned in any number of different locations provided that it is fluidly connected with bladder 420, as would be apparent to one skilled in the relevant art. Additionally, helmet shell 100 may include more than one fluid release mechanism 430.

As an alternative, fluid release mechanism 430 may also be a check valve, or blow off valve, which will open when the pressure in bladder 420 is at or greater than a predetermined level. In each of these situations, bladder 420 will not inflate over a certain amount no matter how much a user attempts to inflate the helmet.

One type of check valve has a spring holding a movable seating member against an opening in the bladder. When the pressure from the air inside the bladder causes a greater pressure on the movable seating member in one direction than the spring causes in the other direction, the movable seating member moves away from the opening allowing air to escape the bladder. Another type of check valve is an umbrella valve, such as the VA-3497 Umbrella Check Valve (Part No. VL1682-104) made of Silicone VL1001M12 and commercially available from Vernay Laboratories, Inc. (Yellow Springs, Ohio, USA). In addition, any other check valve is appropriate for use in the present invention, as would be apparent to one skilled in the art. Further, any check valve would be appropriate for use in any of embodiments of the present invention.

In another embodiment, fluid release mechanism 430 may be an adjustable check valve wherein a user can adjust the pressure at which a valve is released. An adjustable check valve has the added benefit of being set to an individually preferred pressure rather than a factory predetermined pressure. An adjustable check valve may be similar to the spring and movable seating member configuration described in the preceding paragraph. To make it adjustable, however, the valve may have a mechanism for increasing or decreasing the tension in the spring, such that more or less air pressure, respectively, would be required to overcome the three of the spring and move the movable seating member away from the opening in the bladder. However, any type of adjustable check valve is appropriate for use in the present invention, as would be apparent to one skilled in the art, and any adjustable check valve would be appropriate for use in any embodiment of the present invention.

Bladder 420 may include more than one type of fluid release mechanism 430. For example, bladder 420 may include both a check valve and a release valve. Alternatively, bladder 420 may contain, a fluid release mechanism 430 which is a combination release valve and check valve. This type of valve is described in detail in U.S. Pat. No. 7,047,670.

In another embodiment, small perforations may be formed in the bladder to allow air to naturally diffuse through the bladder when a predetermined pressure is reached. The material used to make bladder 420 may be of a flexible material such that these perforations will generally remain closed. If the pressure in the bladder becomes greater than a predetermined pressure the force on the sides of the bladder will open the perforation and air will escape. When the pressure in bladder 420 is less than this predetermined pressure, air will escape very slowly, if at all, from these perforations. Any embodiment of a bladder of the present invention may also have these perforations for controlling the amount of air within the bladder.

As noted elsewhere, these example embodiments have been described for illustrative purposes only, and are not limiting. Other embodiments are possible and are covered by the methods and systems described herein. Such embodiments will be apparent to persons skilled in the relevant art(s) based on the teachings contained herein. Thus, the breadth and scope of the methods and systems described herein should not be limited by any of the above-described exemplary embodiments, but should be defined only in accordance with the following claims and their equivalents

What is claimed is:

1. A helmet comprising:

a shell having a plurality of sections, wherein each section has an exterior surface and an interior surface;

a molded hinge formed intermediate to at least two adjacent shell sections and allowing the at least two sections to move relative to each other;

a liner having a hinge allowing a portion of the liner to move relative to the liner; and an inflatable bladder disposed intermediate to the interior surface of the shell and the liner, the inflatable bladder having a portion disposed on the movable liner portion.

2. The helmet of claim 1, wherein an inflatable air pocket of the inflatable bladder is disposed on the movable liner portion such that when the air pocket is inflated the movable liner portion moves away from a portion of the shell.

3. The helmet of claim 1, further comprising a depression formed in the liner.

4. The helmet of claim 3, wherein the inflatable bladder includes a plurality of air pockets fluidly connected through a channel, and wherein the bladder channel is disposed in the liner depression.

5. The helmet of claim 1, wherein the shell is formed of a first material and the molded hinge is formed of a second material, and wherein the first material and the second material are different materials.

6. The helmet of claim 5, wherein the second material is more flexible than the first material.

7. The helmet of claim 1, further comprising an over-molded bumper provided on at least one of the plurality of shell sections.

8. The helmet of claim 7, wherein the shell is formed of a first material and the over-molded bumper is formed of a second material, and wherein the first material and the second material are different materials.

9. The helmet of claim 8, wherein the first material has a different hardness than the second material.

10. The helmet of claim 1, wherein the molded hinge forms a boundary between adjacent shell sections.

11. The helmet of claim 1, further comprising a flex zone located on a lower rear perimeter of the shell, wherein the flex zone is formed of a more flexible material than the material of the shell.

12. The helmet of claim 1, wherein the liner hinge comprises a molded hinge.

13. The helmet of claim 1, wherein the liner includes a plurality of hinges.

14. A helmet comprising:

a shell having a plurality of sections, wherein each section has an exterior surface and an interior surface;

a molded hinge formed intermediate to at least two adjacent shell sections and allowing the at least two sections to move relative to each other;

an inflatable bladder coupled to a portion of the interior surface of the shell, the inflatable bladder having a plurality of fluidly connected air pockets;

an impact liner for reducing the impact forces acting on a user's head during use, the impact liner having a hinge to allow a portion of the liner to move, wherein an air pocket is disposed on the movable liner portion; and an inflation mechanism fluidly connected to the inflatable bladder.

15. The helmet of claim 14, wherein the liner hinge comprises a molded hinge.

16. The helmet of claim 14, wherein the inflation mechanism is proximate a rear portion of the shell.

17. The helmet of claim 14, further comprising a fluid release mechanism fluidly connected to the inflatable bladder.

18. The helmet of claim 17, wherein the inflation mechanism and the fluid release mechanism are the same device.

19. The helmet of claim 14, further comprising a second liner discrete from the impact liner, wherein at least a portion of the impact liner is disposed intermediate the second liner and the interior surface of the shell.

* * * * *